US012605621B2

(12) United States Patent
Khouri

(10) Patent No.: US 12,605,621 B2
(45) Date of Patent: Apr. 21, 2026

(54) DICE GAME GENERATION USING A DIGITAL COMPONENT

(71) Applicant: Developer J LLC, New Brighton, MN (US)

(72) Inventor: Steven Khouri, New Brighton, MN (US)

(73) Assignee: Developer J LLC, New Brighton, MN (US)

( * ) Notice: Subject to any disclaimer, the term of this patent is extended or adjusted under 35 U.S.C. 154(b) by 276 days.

(21) Appl. No.: 18/144,581

(22) Filed: May 8, 2023

(65) Prior Publication Data

US 2024/0374988 A1 Nov. 14, 2024

(51) Int. Cl.
*A63F 9/00* (2006.01)
*A63F 9/04* (2006.01)

(52) U.S. Cl.
CPC ..... *A63F 9/0406* (2013.01); *A63F 9/001* (2013.01); *A63F 2009/0047* (2013.01); *A63F 2009/0053* (2013.01); *A63F 2009/0411* (2013.01); *A63F 2009/0482* (2013.01)

(58) Field of Classification Search
None
See application file for complete search history.

(56) References Cited

U.S. PATENT DOCUMENTS 1,682,350 A * 8/1928 Ringler ..... B65D 83/08 221/307
2,015,028 A * 9/1935 Gillette ..... B65D 25/205 220/521
2,050,487 A * 8/1936 Durrant ..... B65D 25/02 220/521
2,120,403 A * 6/1938 Godfrey ..... G09F 23/00 220/521
3,227,273 A * 1/1966 Syverson ..... B65B 29/06 206/217
3,893,725 A * 7/1975 Coulter ..... B65F 1/1615 24/302

(Continued)

OTHER PUBLICATIONS

"Build Your Own Board Game", May 2025 at https://www.instructables.com/Build-your-Own-Board-Game/ accessed on May 24, 2025. (Year: 2025).*

(Continued)

*Primary Examiner* — Paul A D'Agostino
(74) *Attorney, Agent, or Firm* — Merchant & Gould P.C.

(57) ABSTRACT

A dice game system includes a plurality of cups, a set of dice, a cover configured to secure the set of dice within the plurality of cups, and a tag included with at least one of the plurality of cups, the set of dice, and the cover, the tag being connected to a digital component that provides digital dice game information. The digital component is configured to perform operations including prompting a user to select a game type, providing, if the selected game type is non-customizable, a ruleset and a scoresheet to the user, prompting the user, if the selected game type is customizable, to game characteristics in a menu of options included with the digital component, receiving the game characteristics from the user via the menu of options, and generating a ruleset in response to the selected customizable game type and the game characteristics entered by the user.

15 Claims, 5 Drawing Sheets

(56) References Cited

U.S. PATENT DOCUMENTS 4,024,951 A * 5/1977 Green ..... B65D 1/265 206/217
4,193,494 A * 3/1980 Green ..... B65D 85/816 206/217
4,227,362 A * 10/1980 Wallsten ..... B29C 67/00 264/296
4,420,081 A * 12/1983 Dart ..... B65D 1/265 206/520
5,099,232 A * 3/1992 Howes ..... B65D 25/00 206/217
5,255,185 A * 10/1993 Mowers ..... A63D 5/04 700/92
D415,390 S * 10/1999 Winnington-Ingram ..... D3/202
6,070,752 A * 6/2000 Nava ..... B65D 51/20 206/217
6,196,411 B1 * 3/2001 Nava ..... B65D 51/20 206/217
6,311,860 B1 * 11/2001 Reidinger ..... B65D 51/28 215/253
6,364,102 B1 * 4/2002 Gordon ..... B65D 51/24 206/217
6,488,282 B1 * 12/2002 Portela ..... A63F 9/0415 273/145 A
6,571,981 B2 * 6/2003 Rohlfs ..... B65D 81/3876 220/839
6,982,733 B1 * 1/2006 McNally ..... G06F 16/9577 715/810
7,195,130 B2 * 3/2007 Pendergrass ..... B65D 43/0212 220/254.1
D541,671 S * 5/2007 Stick ..... D9/744
7,328,791 B1 * 2/2008 Bosworth ..... G11B 33/0427 206/217
7,931,275 B1 * 4/2011 Strickland ..... A63F 1/00 273/145 A
8,176,421 B2 * 5/2012 Dawson ..... A63F 13/12 715/706
D667,314 S * 9/2012 Leija ..... D9/716
8,425,291 B2 * 4/2013 Counts ..... A63F 13/12 463/1
8,602,415 B1 * 12/2013 Denoual ..... A63F 3/00529 D21/372
9,067,140 B2 * 6/2015 Opaluch ..... A63F 13/63
9,533,227 B2 * 1/2017 Chelst ..... A63F 13/847
D783,417 S * 4/2017 Leija ..... D9/716
10,064,507 B1 * 9/2018 Shih ..... B65D 47/12
10,561,947 B1 * 2/2020 Johnston ..... A63F 13/35
10,595,653 B1 * 3/2020 Messilaty ..... B65D 51/20
D906,434 S * 12/2020 Xu ..... D21/372
11,192,028 B2 * 12/2021 Eatedali ..... A63F 13/67
11,302,141 B2 * 4/2022 Simons ..... G07F 17/3223
11,756,376 B2 * 9/2023 Puglisi ..... A63F 13/533 463/43
12,183,124 B2 * 12/2024 Socorregut ..... A63F 3/00895
2003/0177187 A1 * 9/2003 Levine ..... A63F 13/10 709/205
2006/0040720 A1 * 2/2006 Harrison, Jr. ..... A63F 9/24 463/9
2006/0080175 A1 * 4/2006 Rowe ..... G06Q 30/0209 463/16
2006/0123053 A1 * 6/2006 Scannell, Jr. ..... G06F 16/9577
2006/0148560 A1 * 7/2006 Arezina ..... G07F 17/323 463/25
2006/0281555 A1 * 12/2006 Kellerman ..... G07F 17/3244 463/42
2007/0015564 A1 * 1/2007 Walker ..... G06Q 30/02 463/16
2007/0191100 A1 * 8/2007 Counts ..... A63F 13/12 463/42
2007/0207855 A1 * 9/2007 Moody ..... G07F 17/3293 463/31
2008/0016176 A1 * 1/2008 Leitner ..... H04L 67/131 709/217
2008/0020848 A1 * 1/2008 Muir ..... G07F 17/3262 463/42
2008/0036144 A1 * 2/2008 Maling ..... A63F 3/00157 273/146
2008/0045317 A1 * 2/2008 Seelig ..... G07F 17/3239 463/43
2008/0083639 A1 * 4/2008 Peterman ..... A47J 47/02 206/508
2008/0203657 A1 * 8/2008 Hole ..... A63F 9/04 273/146
2009/0082082 A1 * 3/2009 Carr-Gregg ..... G07F 17/32 463/43
2009/0149246 A1 * 6/2009 Opaluch ..... A63F 13/30 463/30
2009/0276982 A1 * 11/2009 Nossa ..... B65D 43/22 24/305
2009/0318219 A1 * 12/2009 Koustas ..... G07F 17/3295 463/23
2009/0322023 A1 * 12/2009 Denoual ..... A63F 9/04 273/145 A
2009/0325136 A1 * 12/2009 Delbue ..... A63F 13/25 434/322
2011/0006478 A1 * 1/2011 Cline ..... A63F 9/04 273/146
2013/0073357 A1 * 3/2013 Gillibrand ..... G06Q 30/02 705/14.11
2013/0246136 A1 * 9/2013 Ramsey ..... G06Q 10/0835 705/26.7
2014/0051497 A1 * 2/2014 Lang ..... G07F 17/3241 463/25
2014/0310018 A1 * 10/2014 Cizmarik ..... G16H 40/40 705/2
2014/0319770 A1 * 10/2014 Mizanoski ..... A63F 9/04 273/146
2015/0297984 A1 * 10/2015 Ogilvie ..... A63F 11/00 273/148 R
2017/0020783 A1 * 1/2017 Shani ..... B65D 77/0493
2017/0251852 A1 * 9/2017 O'Nan ..... B65D 1/46
2017/0253354 A1 * 9/2017 Colson ..... B33Y 10/00
2018/0020814 A1 * 1/2018 Pasinski ..... A45F 3/02 224/148.4
2018/0185742 A1 * 7/2018 Svehaug ..... A63F 3/00529
2020/0023264 A1 * 1/2020 Chardon ..... A63F 1/00
2020/0397194 A1 * 12/2020 Goldberg ..... G06T 19/006
2022/0027941 A1 * 1/2022 Ramboz ..... G06Q 30/0223
2024/0091630 A1 * 3/2024 Wright ..... A63F 9/0495
2024/0149145 A1 * 5/2024 Triepel ..... A63F 9/0406
2024/0153334 A1 * 5/2024 Everton ..... G06Q 30/0237
2024/0374988 A1 * 11/2024 Khouri ..... A63F 9/001

OTHER PUBLICATIONS

"Game Materials" May 2025, https://www.cupsndice.com/instructions accessed on May 24, 2025. (Year: 2025).*
"My Life Announces Custom-Designed Monopoly and Scrabble Games", Hasbro, Nov. 20, 2014, chrome-extension://efaidnbmnnnibpcajpcglclefindmkaj/https://corp.hasbro.com/static-files/0eeca15f-5fbb-4ed0-b5e5-b2dd20731d1c accessed on May 24, 2025. (Year: 2014).*
"Official Yahtzee Rules", May 24, 2025, https://officialgamerules.org/game-rules/yahtzee/ accessed on May 24, 2025. (Year: 2025).*
Card Games, May 24, 2025, PrintNinja.com/get-started accessed on May 24, 2025. (Year: 2025).*
"Files" on boardgamegeek.com, May 24, 2025 at https://boardgamegeek.com/files/boardgame/all accessed on May 24, 2025. (Year: 2025).*
Archive_org_Sep_21_2020_Liars_Dice_on_Dicegamedepot_com (Year: 2020).*
Archive_org_Sep_23_2020_Bunco_Rules_page_at_Dicegamedepot_com (Year: 2020).*
Archive_org_Sep_23_2020_Dice_Game_Depot_Home_page_at_Dicegamedepot_com. (Year: 2020).*
Archive_org_Sep_25_2020_Beetle_Rules_page_at_Dicegamedepot_com (Year: 2020).*
Archive_org_Sep_26_2020_Farkle_Rules_page_at_Dicegamedepot_com (Year: 2020).*

(56) References Cited

OTHER PUBLICATIONS www.playmonster.com, "Farkle—Play Monster", https://www.playmonster.com/product/farkle/, 2022, 6 pages.
shop.hasbro.com, "Yahtzee Classic—Hasbro Games", https://shop.hasbro.com/en-us/product/yahtzee-classic/8F0B984E-6D40-1014-8BF0-9EFBF894F9D4, Hasbro Shop, 2023, 12 pages.
www.woodexpressions.com, "We Games Dice Cup Set—4 Professional Grade Plastic with 20 Dice and Instructions for Liar's Dice Plus 10 Different Games", https://woodexpressions.com/product/dice-cups-set-of-4-professional-grade-plastic-with-20-dice-instructions-for-liar/, 2016, 5 pages.
www.etsy.com, "Farkle Dice Tray, Personalized Farkle Game, Farkle Game with Optional QR Code for Rules", https://www.etsy.com/listing/1163980837/farkle-dice-tray-personalized-farkle?ga_order=most_relevant&ga_search_type=all&ga_view_type=gallery&ga_search_query=farkle+dice+game&ref=sr_gallery-1-5&col=1&organic_search_click=1, Mar. 11, 2023, 11 pages.
www.playonlinedicegames.com, "Play Online Dice Games", http://web.archive.org/web/20230127220026/http://www.playonlinedicegames.com/, Jan. 27, 2023, 33 pages.
GoDice, https://www.amazon.com/dp/B09TL9SCTZ, 7 pages.

* cited by examiner

DICE GAME GENERATION USING A DIGITAL COMPONENT

TECHNICAL FIELD

The present disclosure relates to dice games. In particular, the present disclosure relates to dice games generated using a software-based digital component.

BACKGROUND

Dice games have been a popular form of entertainment dating back to their origins in ancient China and Egypt. The general purpose of every dice game is to roll one or more dice each having a variety of faces distinguished by a different numerical value or other symbol with the aim of obtaining a specific score or other combination based on the face(s) facing upwards after the roll. Dice games typically involve several players competing against each other using a set of rules unique to the game being played. The score for each player is generally recorded on a physical scoresheet such as a piece of paper using a writing utensil.

While the general game play of every dice game is similar, the rules and instructions tend to vary. For example, Liar's Dice is a popular folk game in which a player attempts to determine whether the other players in the game are lying about the score they obtained from their dice roll. The rules of Liar's Dice vary depending on the number of players, the number of dice available, whether the game is played solo or with a team, the bidding process, how dice are scored, and other game or player-related characteristics. Another example is Farkle where players score points based on their dice rolls with the goal of reaching a certain point value. The point values can vary depending on, for example, the number of dice available and the number of faces on each dice.

One challenge with the conventional approach to playing dice games like Liar's Dice is that it can be difficult to alter the rules to accommodate new circumstances. For example, an increase in the number of players or choosing to play with a different number of dice generally requires a change in rules which can be complicated and burdensome to keep track of. Another challenge arises when switching between dice games that have significantly different rules. Generally, each individual dice game is sold separately with separate scoresheets so that a player only has what they need to play that specific dice game. Other dice games are sold in a similar manner which means a player must purchase or obtain each individual game if they want to play them all. Farkle, Yacht, Crag, and Bunco are all examples of dice games that have separate scoresheets, but the commonality between these games is that they are all sold with a cup or a plurality of cups along with several dice.

SUMMARY

Systems and methods are disclosed for generating dice game information using a digital component that allows a user to select a game type and, if the selected game type is customizable, use a rule generator that accepts user-entered game characteristics to generate a ruleset specific to the selected customizable game type and the entered game characteristics. If the selected game type is non-customizable, the digital component is configured to provide a ruleset and a scoresheet to the user both corresponding to the selected non-customizable game type.

Several dice game types mentioned in this disclosure, including Liar's Dice, generally make use of cups for, among other things, rolling dice and concealing the numerical values or other symbols facing upwards on the dice after the roll. For storage and transportation purposes, the cups and dice may be secured together using a cover and a removable band that can simultaneously bias the cover onto a topmost cup of the plurality of cups and force the plurality of cups together from a bottommost cup of the plurality of cups. A tag that connects to the digital component may be included with the cups, the dice, the cover, and/or any other suitable display location easily visible to a user. The user may access the digital component by pointing a camera included with a smart electronic device at the tag which automatically converts the machine-readable language embedded in the tag into information usable by the user. The disclosed systems and methods thus represent an improvement over the conventional approach to playing dice games.

In embodiments, a dice game system includes a plurality of cups, a set of dice, a cover configured to secure the set of dice within the plurality of cups, and a tag included with at least one of the plurality of cups, the set of dice, and the cover, the tag being connected to a digital component that provides digital dice game information. The digital component is configured to perform operations, stored in a non-transitory computer readable medium, using a processor, the operations including prompting a user to select a game type from a list of customizable game types and non-customizable game types, providing, if the selected game type is non-customizable, a ruleset and a scoresheet to the user, prompting the user, if the selected game type is customizable, to enter one or more game characteristics in a menu of options included with the digital component, receiving the one or more game characteristics from the user via the menu of options included with the digital component, and generating a ruleset in response to the selected customizable game type and the one or more game characteristics entered by the user.

In embodiments, a method is provided of generating, using a processor, dice game information prompted by user access to a digital component via a tag, the method performing operations stored in a non-transitory computer readable medium, the operations including prompting a user, upon access to the digital component, to select a game type from a list of customizable game types and non-customizable game types, providing, if the selected game type is non-customizable, a ruleset and a scoresheet to the user, prompting the user, if the selected game type is customizable, to enter one or more game characteristics in a menu of options included with the digital component, receiving the one or more game characteristics from the user via the menu of options included with the digital component, and generating a ruleset in response to the selected customizable game type and the one or more game characteristics entered by the user.

The above summary is not intended to describe each illustrated embodiment or every implementation of the subject matter hereof. The figures and the detailed description that follow more particularly exemplify various embodiments.

BRIEF DESCRIPTION OF THE DRAWINGS

Subject matter hereof may be more completely understood in consideration of the following detailed description of various embodiments in connection with the accompanying figures, in which.

Figure 1:
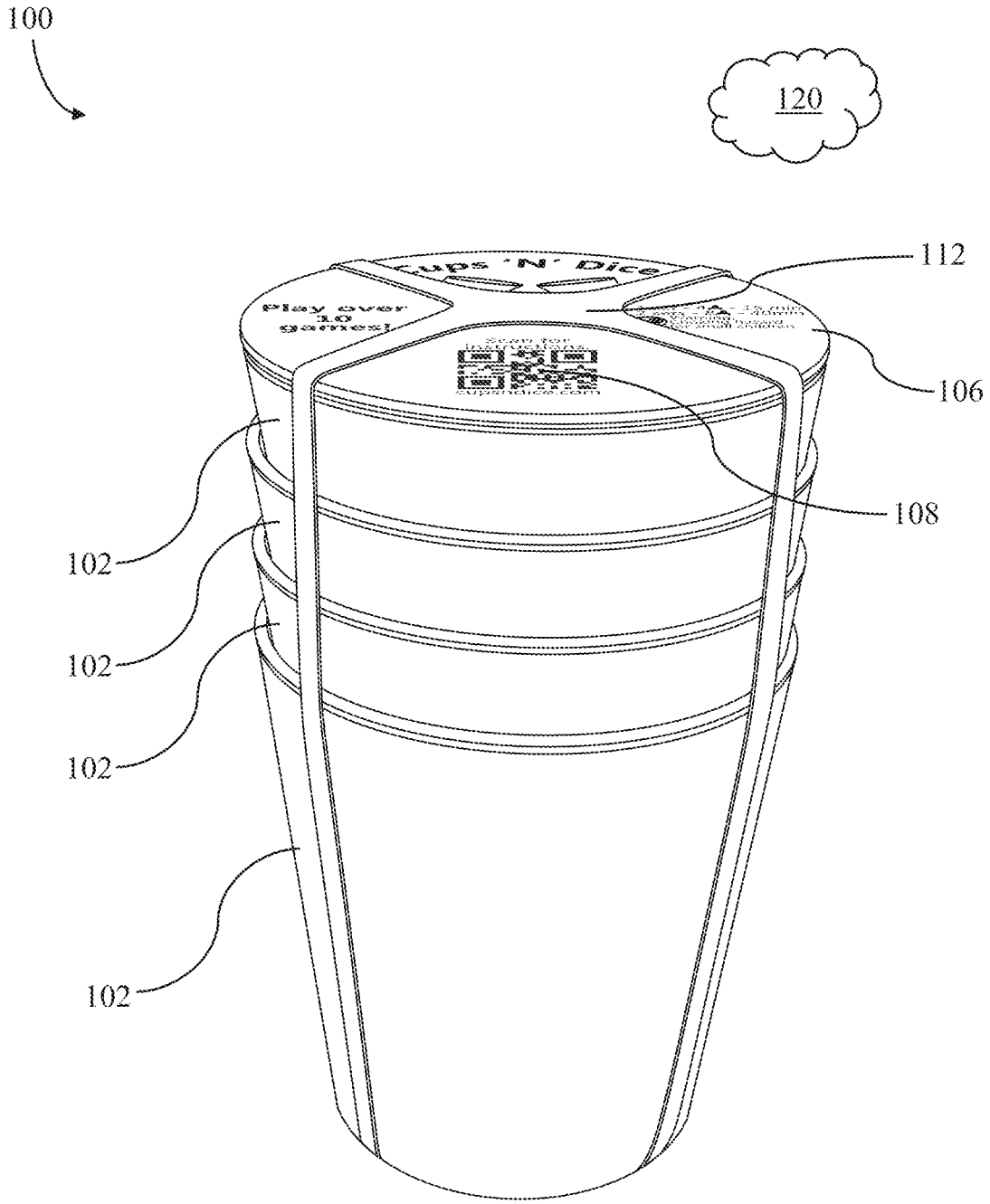
FIG. 1 is an isometric view of a dice game system, according to an embodiment of the disclosure.

While various embodiments are amenable to various modifications and alternative forms, specifics thereof have been shown by way of example in the drawings and will be described in detail. It should be understood, however, that the intention is not to limit the claimed inventions to the particular embodiments described. On the contrary, the intention is to cover all modifications, equivalents, and alternatives falling within the spirit and scope of the subject matter as defined by the claims.

DETAILED DESCRIPTION OF THE DRAWINGS

Figure 2:
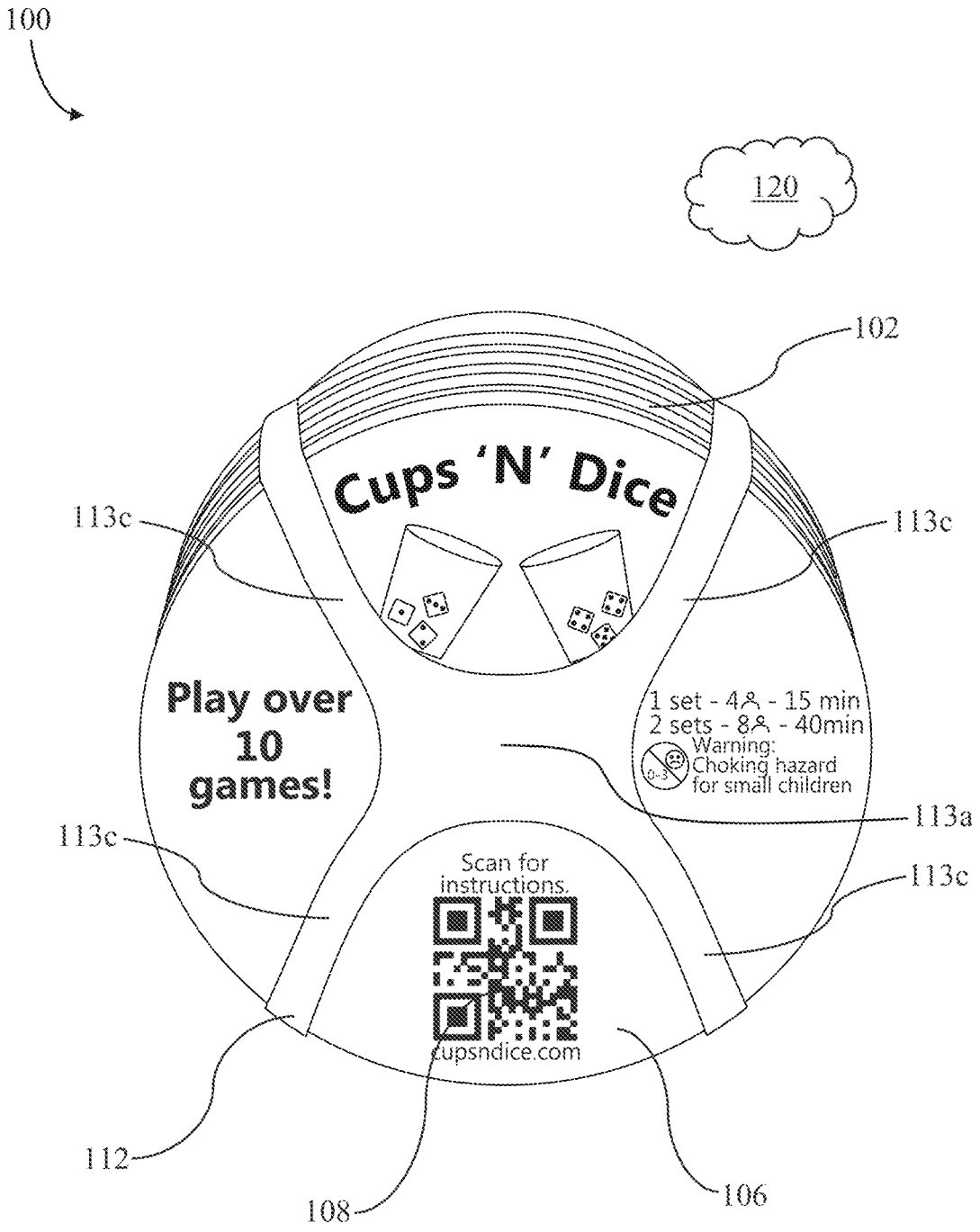
FIG. 2 is a top view of a dice game system, according to an embodiment of the disclosure.
Figure 3:
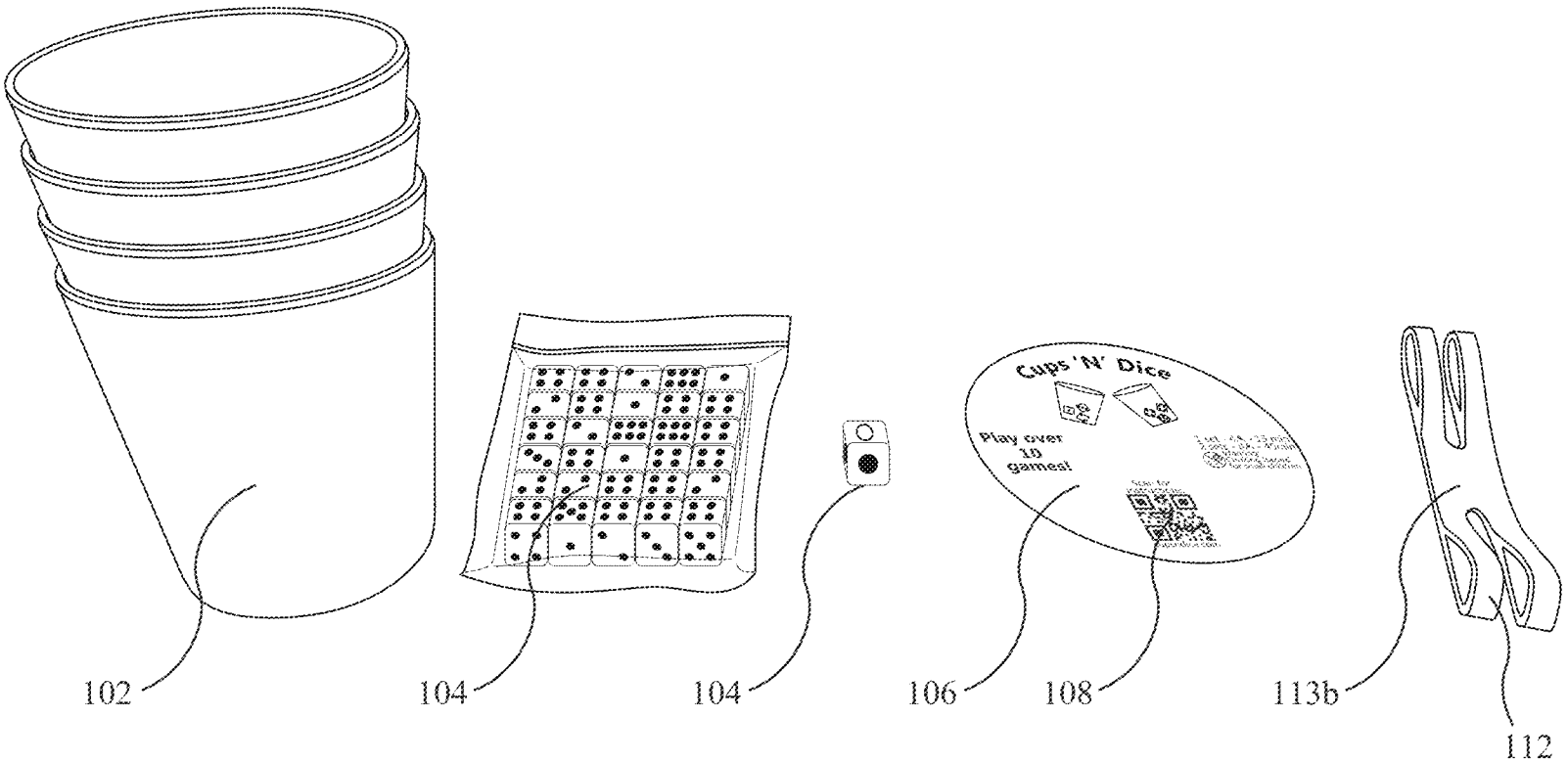
FIG. 3 is an exploded view of a dice game system, according to an embodiment of the disclosure.

Referring generally to FIGS. 1-3, a dice game system 100 according to an embodiment of the disclosure may comprise a plurality of cups 102, a set of dice 104, a cover 106 configured to secure the set of dice within the plurality of cups, a tag 108 connected to a digital component 120, and a band 112 wrapped around the plurality of cups 102 and the cover 106.

Plurality of cups 102 generally have a cylindrical or frustoconical thin-walled geometry with an open portion opposite a closed, base portion. Plurality of cups 102 are intended to be stacked together which can be achieved using a frustoconical thin-walled geometry with a diameter tapered starting from the open portion and ending at the closed, base portion. Generally, friction between each cup 102 prevents plurality of cups 102 from separating when stacked together in a column formation. Plurality of cups 102 may include one or more strips formed around a circumference thereof for more ergonomic gripping by a user. One of ordinary skill in the art will recognize that plurality of cups 102 can be manufactured from a variety of materials suitable for storing drinkable liquids, including plastics, metals, woods, and composite materials.

Set of dice 104 can be stored within a single cup 102 of the plurality of cups 102 between uses of dice 104. As an example, set of dice 104 can be formed as a six-sided cubical structure with each side having one or more circular indents indicating the numerical value assigned to that side. Other geometries and configurations of set of dice 104 are contemplated for use with dice game system 100, including configurations that use symbols or other numerical representations to represent the value of each face.

Cover 106 generally has a cylindrical geometry with a thin thickness suitable for covering a topmost cup 102 of the plurality of cups 102. One of ordinary skill in the art will recognize that cover 106 can be manufactured from a variety of materials including plastics, metals, woods, and composite materials. Cover 106 may be used as a coaster that a liquid storage device such as a metallic can or bottle can rest on when placed on a table or other surface. Typically, cover 106 is secured to plurality of cups 102 by a band 112 that extends along the combined length of cover 106 and plurality of cups 102. In other embodiments, cover 106 may be secured to plurality of cups 102 using magnets, adhesives, fasteners, mechanical clips, or any other suitable attachment method.

Band 112 can be implemented using variety of suitable structures made from flexible or non-flexible materials. In a particular embodiment, band 112 is made from a flexible plastic material that has a first contact surface 113*a* integrally connected to a second contact surface 113*b* by several segments 113*c*. During use of this embodiment of band 112, first contact surface 113*a* is touching a top surface of cover 106, second contact surface 113*b* is touching the closed, base portion of a bottommost cup 102 of the plurality of cups 102, and the several segments 113*c* stretch along the combined length of cover 106 and plurality of cups 102. As such, band 112 simultaneously provides a force biasing the cover 106 onto the top of the plurality of cups 102 and a force holding the plurality of cups 102 together from the bottommost cup 102. Removal of band 112 eliminates both the biasing force against cover 106 and the force holding the plurality of cups 102 together.

Tag 108 may comprise a quick response (QR) code, a bar code, a uniform resource locator (URL), a near-field communication (NFC) tag, a Bluetooth Low Energy (BLE) tag (e.g., a beacon tag), or any other symbol characterized as a digital indicator. Tag 108 may be included with plurality of cups 102, set of dice 104, cover 106, and/or any other suitable display location easily visible to a user. When tag 108 is a QR code, a user can employ a camera included with a smart electronic device to translate the sequence of black squares and dots that comprise the QR code into usable information. Discussion of the creation of a QR code is beyond the scope of this disclosure though one of ordinary skill in the art has the requisite knowledge and skills to create and implement a QR code tag 108 or any other digital indicator tag 108 compatible with dice game system 100.

When interacted with by a user, tag 108 is configured to prompt the user to access a digital component 120 stored on a website or another similar permanent storage location on the user's smart electronic device. In embodiments, digital component 120 is a graphical user interface having several menus and/or icons that a user may interact with. Accessing digital component 120 presents the user with a variety of customizable and non-customizable dice game types including "Liars Dice, Dudo, Perudo," "Cant The Dice Game," "Yacht, Yatzy, Generala," "Crag," "Farkle," "Bunco," "Dice Holdem," "Macao," "Mia," "Midnight," "High-Low-Middle Midnight," "Petals Around The Rose," "Pig," "Seven Eleven Doubles," and "Street Craps." Digital scoresheets for several of the dice game types are also presented to the user upon accessing the digital component 120. The digital scoresheets include a mechanism for automatically calculating score based on user-entered point values. For example, the digital scoresheet for the dice game Crag may include the following categories for keeping track of score:

Ones: Sum of all the 1s [Score]
Twos: Sum of all the 2s [Score]
Threes: Sum of all the 3s [Score]
Thirteen: 26 points for combinations with a sum of 13 [Score]
Crag: 50 points for combinations with a pair and a sum of 13 [Score]
Total [Score]

Other digital scoresheets provide similar approaches for tracking score albeit specific to the rules of different dice game types (and thus different score entries). In embodiments, the digital component 120 includes a timer with dice game types such as the "Cant" game for indicating when a player should roll the set of dice 104. The timer may have a variety of preset countdown times starting at 5 seconds and ending at 60 seconds and arranged from shortest to longest.

Each dice game type provided with the digital component 120 includes instructions for playing the game such as setup, game objective and scoring, gameplay rules, and game variations. The instructions are provided in sufficient detail that a user need only refer to the information stored in the digital component 120 to prepare and play any of the variety of dice game types. Certain customizable game types, such as Liar's Dice for example, includes a menu of options where a user can enter game characteristics specific to their playing environment. An example menu of options is as follows:

Preliminary Questions

How many players are playing total? [insert number]

Game Settings

Dice Per Player [1; 2; 3; 4; 5; No Limit On Dice]

Collaborative Play [Standard Singles Play; Team Play]

Bidding Process [Quantity Bidding; Face Value Reset Bidding; Total Multiple Bidding; Multiplicand (Perudo) Bidding]

Dice Scoring [Communal Dice Scoring; Solitary Dice Scoring; Team Dice Scoring]

Game Progression [Dice Loss; Dice Theft; Dice Gifting; Three Lives; Sudden Death]

Ones As Wildcards [Off; On]

Power Up Dice [Off, On]

If Power Up Dice On: Power Up Rolls [1; 2; 3]

Mystery Cup [Off; On]

If Mystery Cup On: Mystery Cup Dice Limit [1; 2; 3; 4; 5; No Limit On Dice]

[Create Game] [Randomize Rules]

After entering game characteristics, a user can select the "Create Game" option which automatically generates a ruleset specific to the information the user entered. For example, using the game characteristics Four players, No Limit On Dice, Standard Singles Play, Multiplicand (Perudo) Bidding, Team Dice Scoring, Sudden Death, No Wildcards, No Power Up Dice, and Mystery Cup On with Four Dice, the digital component 120 automatically generates the following ruleset for Liar's Dice:

Setup

You told us you have 4 players, you will need 1 set(s) of 'Cups N Dice' to play with that many players. Since you are playing with 'mystery cup' rules you might need one more cup for the Game. If you have an extra set of 'Cups N Dice' use one of those cups. Otherwise, any cup you can get around the house works so long as you cannot see through it. Each player should be given a single cup with any equal amount of dice. Set aside a single cup to use as a mystery cup, if you don't have an extra cup to use, wait until the first player loses the game and use their cup. The Mystery Cup will be explained in more depth in the Special Rules section.

Game Objective

Liars dice is a game where you want to be the last player standing. 'single play' was selected for this game. This means each player is playing for themselves and not collaborating with others to win.

Gameplay

Liars Dice is a turn taking game. A round of Liars Dice is split into four phases: the Rolling phase, the Bidding Phase, the Scoring Phase, and the Progression Phase.

Rolling Phase

At the beginning of a round, players roll their dice together. At the count of 3 the dice rolling is stopped. These dice are not to be rerolled until the round is over. If a player is caught re-rolling that is an automatic loss of the game. The starting player is chosen arbitrarily for the first round. The starting player begins the Bidding Phase after the Rolling Phase is over.

Bidding Phase

Once the Rolling Phase is done players take turns bidding in clockwise order. The bidding declaration follows the following structure: A player must bid a quantity followed by the dice value that does not exceed six (for the six faces of the dice). A bid of four fives indicates a player believes there are four dice with a face value of five. Eight sixes indicate the player believes there are eight dice with face value of six on the table. There are several bidding types for this game you have chosen 'multiplicand' bidding. As players bid the next player is required to bid a higher multiplicand. So, if player A bids five sixes then player B can bid any dice value so long as he beats the multiplicand of five, so six twos would be a valid bid because the multiplicand is six.

Players bid until an accuser calls a bidder a liar. Players are required to bid in turn order or call another player a liar, those are the only two options in the Bidding Phase. Anyone can call a bidder a liar at any time. If two people declare the bidder a liar, then the player that is closest in turn order after the bidder takes priority as accuser. This is regardless of who called liar first. Once a liar is called out, the next phase is scoring phase to see who won between the bidder or accuser.

Scoring Phase

Once a liar is accused, players must count the dice. Since you have chosen 'team scoring' for this game, one must count all the players' dice in the bidder's scoring team to see if the bid is valid. Your scoring team is chosen arbitrarily so long as each scoring team has the same amount of players. After scoring if the bidder was caught with an invalid bid, then the bidder has lost and the accuser has won. If the bid is valid, the accuser has lost and the bidder has won. After Scoring the game moves into the Progression Phase where a punishment for the loser is specified.

Progression Phase

In a 'Sudden Death' game the round loser is kicked out immediately. A loss of a round results in an immediate loss of the game. Once the round is over the losing player starts the next round. If the loser is out, the next player starts the round. The game progression rules are setup in a way where there will eventually be a winner. Repeat the four phases until there is only one player with dice left.

Special Rules

Mystery Cup

In this game the Mystery Cup is included. The Mystery Cup is an extra cup added to the game. It is rolled at the beginning of the round. No player owns this cup, but it is included in the dice scoring for everyone. The Mystery Cup is limited at 3 dice in this game. If an extra cup is not present wait until a player loses and then use their cup. If extra dice are not present, then you can feed the cup players' dice as they lose. In some game rule scenarios, the cup will never have dice, continue play as if the cup was never included.

If the user wants to change the ruleset for any reason (e.g., increase the number of players, wrong number of dice), the digital component 120 is configured to save the previously entered game characteristics and allows the user to alter them as needed and then regenerate the ruleset. One benefit of this process is that downtime between games is minimized when compared to the conventional approach of having to manually redesign the rules and explain the changed ruleset to other players. Another benefit is that dice game system 100 and digital component 120 allow a user to experiment with different game characteristics to generate new rulesets designed for novel game experiences. The digital component 120 can design over 200,000 variants of play for Liar's Dice, some of which are unique to the embodiments of this disclosure.

The digital component 120 may also include several predetermined rulesets based on various game qualities such as game complexity and average time to completion. For example, the digital component 120 may include the following predetermined rulesets for Liar's Dice ordered by increasing game complexity:

Least Complex [Pirates Dice Rules]

More Complex [Pirates Dice Rules+Wildcards]

Complex [Change Game Progression to Dice Loss+Wildcards+Power Up Dice]

Very Complex [Change Game Progression to Dice Theft+Wildcards+Power Up Dice+Mystery Cup]

The Liar's Dice predetermined rulesets automatically fill the dice per player, game progression, ones as wildcards, power up dice, power up rolls, mystery cup, and mystery cup dice limit game characteristics based on the game quality level selected. Generally, a user must still enter the number of players, the type of collaborative play, the bidding process, and dice scoring setting to accurately generate a particular predetermined ruleset that satisfies the user's playing environment.

Figure 4:
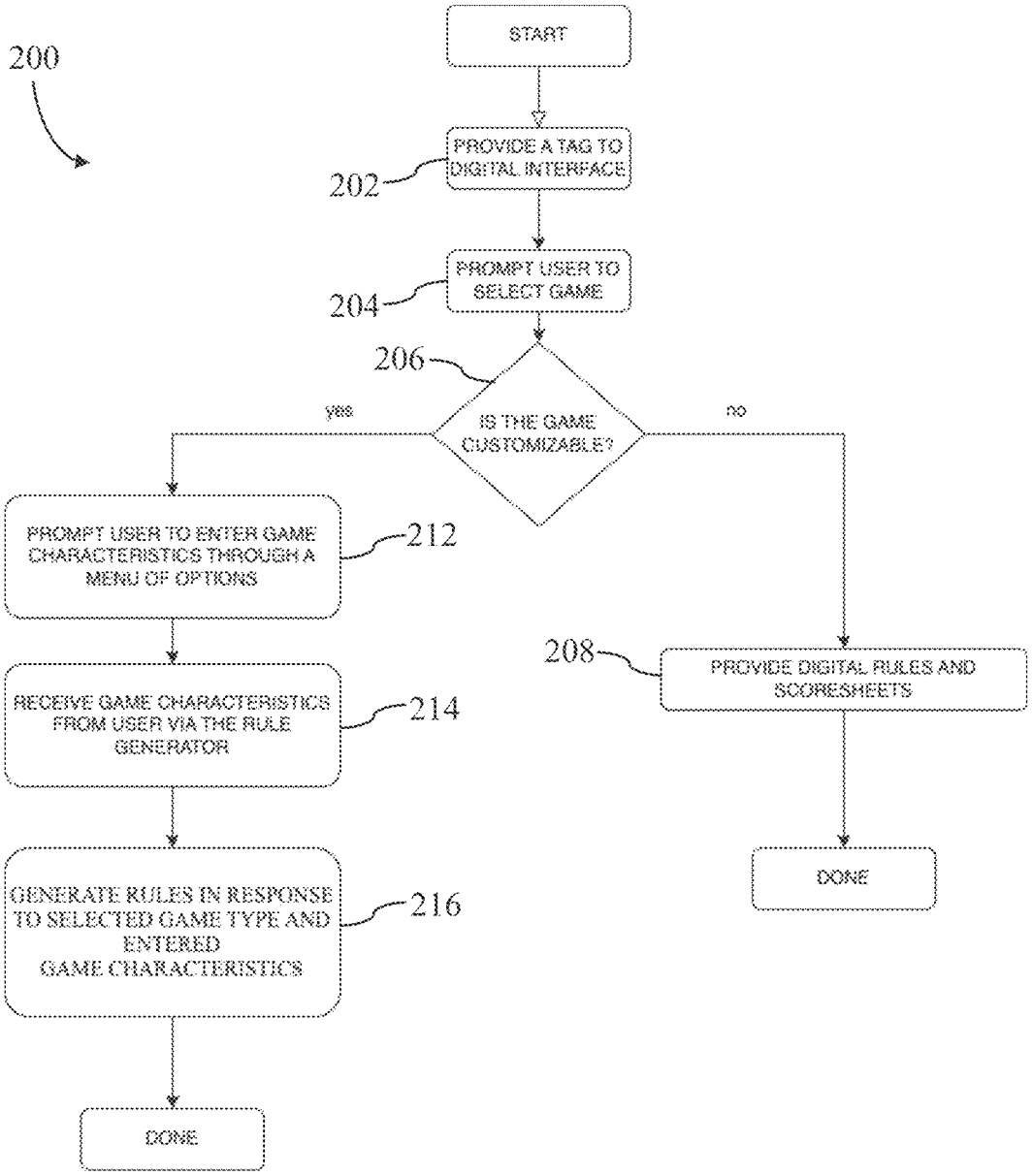
FIG. 4 is a method of generating dice game information using a digital component, according to an embodiment of the disclosure.
Figure 5:
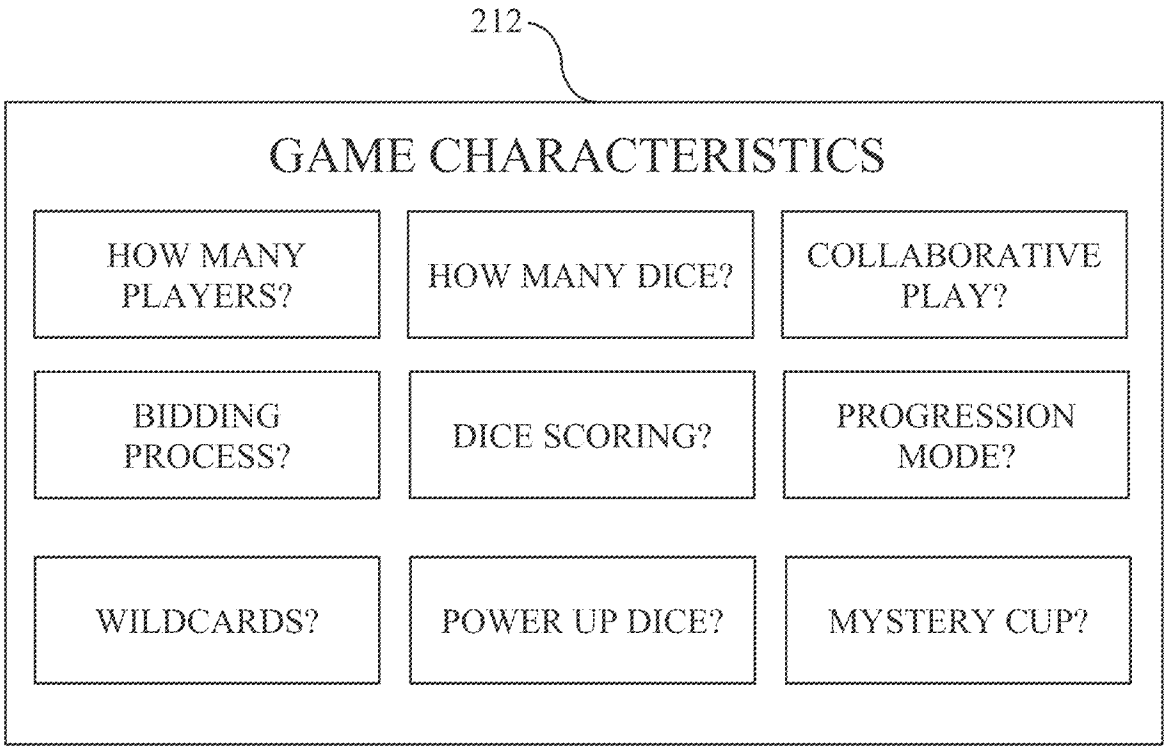
FIG. 5 depicts a variety of game characteristics associated with generating dice game information using a digital component, according to an embodiment of the disclosure.

Referring now generally to FIGS. 4 and 5, a method 200 of generating dice game information using a digital component 120 according to an embodiment of the disclosure is depicted. At 202, a tag 108 connected to the digital component 120 is provided to a user. Tag 108 is generally included on a surface of cover 106 but may also be included with plurality of cups 102 or set of dice 112, alternatively or in addition. At 204, upon accessing the digital component 120, a user is prompted to select a game type from a list of customizable game types (e.g., Liar's Dice) and non-customizable game types (e.g., Crag, Farkle, and Yacht) included with the digital component 120. Several game types include a corresponding digital scoresheet which negates the need for tracking score using a physical scoresheet. At 206, the digital component 120 determines whether the game type selected by the user is customizable or non-customizable. If the selected game type is non-customizable, the digital component 120 provides a ruleset and a scoresheet to the user at 208.

If the selected game type is customizable, the digital component 120 prompts a user to enter one or more game characteristics through a menu of options at 212. As shown in FIG. 5 as an example, number of players, number of dice, collaborative play, bidding process, dice scoring, game progression, wildcards, power up dice, and mystery cup are all game characteristics that the digital component 120 may use to create a unique ruleset for Liar's Dice.

At 214, after the user has entered one or more game characteristics and selected a "Create Game" option, the digital component 120 receives the one or more game characteristics and subsequently at 216 generates a ruleset in response to the selected customizable game type and the entered one or more game characteristics. The ruleset provides instructions for playing the selected customizable game type based on the game characteristic information provided to the digital component 120. In embodiments, the digital component 120 also creates a digital scoresheet specific to the game characteristic information entered by the user. The benefit of this approach is that a digital scoresheet specifically tailored to the generated ruleset is created and immediately made available to the user without any changes needed.

Various embodiments of systems, devices, and methods have been described herein. These embodiments are given only by way of example and are not intended to limit the scope of the claimed inventions. It should be appreciated, moreover, that the various features of the embodiments that have been described may be combined in various ways to produce numerous additional embodiments. Moreover, while various materials, dimensions, shapes, configurations and locations, etc. have been described for use with disclosed embodiments, others besides those disclosed may be utilized without exceeding the scope of the claimed inventions.

Persons of ordinary skill in the relevant arts will recognize that the subject matter hereof may comprise fewer features than illustrated in any individual embodiment described above. The embodiments described herein are not meant to be an exhaustive presentation of the ways in which the various features of the subject matter hereof may be combined. Accordingly, the embodiments are not mutually exclusive combinations of features; rather, the various embodiments can comprise a combination of different individual features selected from different individual embodiments, as understood by persons of ordinary skill in the art. Moreover, elements described with respect to one embodiment can be implemented in other embodiments even when not described in such embodiments unless otherwise noted.

Although a dependent claim may refer in the claims to a specific combination with one or more other claims, other embodiments can also include a combination of the dependent claim with the subject matter of each other dependent claim or a combination of one or more features with other dependent or independent claims. Such combinations are proposed herein unless it is stated that a specific combination is not intended.

For purposes of interpreting the claims, it is expressly intended that the provisions of 35 U.S.C. § 112 (f) are not to be invoked unless the specific terms "means for" or "step for" are recited in a claim.

The invention claimed is:

1. A dice game system, comprising:

a plurality of cups;

a set of dice;

a cover configured to secure the set of dice within the plurality of cups; and a tag included with at least one of the plurality of cups, the set of dice, and the cover, the tag connected to a digital component that provides digital dice game information, wherein the digital component is configured to perform operations, stored in a non-transitory computer readable medium, using a processor, the operations comprising:

prompting a user to select a game type from a list of customizable game types and non-customizable game types;

providing, if the selected game type is non-customizable, a ruleset and a scoresheet to the user;

prompting the user, if the selected game type is customizable, to enter one or more game characteristics in a menu of options included with the digital component;

receiving the one or more game characteristics from the user via the menu of options included with the digital component; and generating a ruleset in response to the selected customizable game type and the one or more game characteristics entered by the user.

2. The dice game system of claim 1, wherein the one or more game characteristics are number of players, number of dice, type of collaborative play, type of bidding process, type of dice scoring, type of progression mode, whether to include wildcards, whether to include power up dice, or whether to include mystery cup.

3. The dice game system of claim 1, wherein the digital component includes a setting for generating a randomized ruleset based on a user-entered number of players.

4. The dice game system of claim 1, wherein the digital component includes a plurality of predetermined rulesets.

5. The dice game system of claim 1, wherein the digital component includes a timer having a plurality of preset countdown times.

6. The dice game system of claim 1, wherein the one or more game characteristics are saved in the digital component after the operation of generating a ruleset in response to the selected customizable game type and the one or more game characteristics entered by the user.

7. The dice game system of claim 1, wherein the scoresheet is specifically formatted to accommodate the selected non-customizable game type.

8. A method of generating, using a processor, dice game information prompted by user access to a digital component via a tag, the method performing operations stored in a non-transitory computer readable medium, the operations comprising:

prompting a user, upon access to the digital component, to select a game type from a list of customizable game types and non-customizable game types;

providing, if the selected game type is non-customizable, a ruleset and a scoresheet to the user;

prompting the user, if the selected game type is customizable, to enter one or more game characteristics in a menu of options included with the digital component;

receiving the one or more game characteristics from the user via the menu of options included with the digital component; and generating a ruleset in response to the selected customizable game and the one or more game characteristics entered by the user.

9. The method of claim 8, wherein the tag is a quick response (QR) code, a near-field communication (NFC) tag, or a beacon tag.

10. The method of claim 8, wherein the tag is included with a cover for a cup used for storing liquids.

11. The method of claim 8, wherein the one or more game characteristics are number of players, number of dice, type of collaborative play, type of bidding process, type of dice scoring, type of progression mode, whether to include wildcards, whether to include power up dice, or whether to include mystery cup.

12. The method of claim 8, further comprising generating a randomized ruleset for a customizable game type based solely on a user-entered number of players.

13. The method of claim 8, wherein the digital component includes a plurality of predetermined rulesets.

14. The method of claim 8, wherein the scoresheet is specifically formatted to accommodate the non-customizable game type.

15. The method of claim 8, further comprising saving the one or more game characteristics in the digital component after generating a ruleset in response to the selected customizable game type and the one or more game characteristics entered by the user.

* * * * *